US011002004B2

(12) United States Patent
Titov et al.

(10) Patent No.: US 11,002,004 B2
(45) Date of Patent: May 11, 2021

(54) METHOD FOR ERECTING FRAMEWORK OF STRUCTURES

(71) Applicants: Aleksandr Aleksandrovich Titov, Moscow (RU); Dmitri Viktorovich Paramonov, Moscow (RU); Vladislav Aleksandrovich Levushkin, Moscow (RU)

(72) Inventors: Aleksandr Aleksandrovich Titov, Moscow (RU); Dmitri Viktorovich Paramonov, Moscow (RU); Vladislav Aleksandrovich Levushkin, Moscow (RU)

( * ) Notice: Subject to any disclaimer, the term of this patent is extended or adjusted under 35 U.S.C. 154(b) by 24 days.

(21) Appl. No.: 16/304,858

(22) PCT Filed: May 19, 2017

(86) PCT No.: PCT/RU2017/000325

§ 371 (c)(1),
(2) Date: Nov. 27, 2018

(87) PCT Pub. No.: WO2017/209650

PCT Pub. Date: Dec. 7, 2017

(65) Prior Publication Data

US 2019/0309508 A1 Oct. 10, 2019

(51) Int. Cl.
*E04B 1/35* (2006.01)
*E04B 5/17* (2006.01)
(Continued)

(52) U.S. Cl.
CPC ..... *E04B 1/35* (2013.01); *E04B 1/16* (2013.01); *E04B 1/20* (2013.01); *E04B 1/22* (2013.01);
(Continued)

(58) Field of Classification Search
USPC .... 52/742.14–742.16, 745.11, 745.14, 745.2
See application file for complete search history.

(56) References Cited

U.S. PATENT DOCUMENTS 3,713,265 A * 1/1973 Wysocki ..... E04B 1/3511 52/745.14
3,892,055 A * 7/1975 Ljung ..... E04B 1/35 52/745.1
(Continued)

FOREIGN PATENT DOCUMENTS

SU 372334 A1 * 3/1973
SU 737600 A1 * 5/1980
SU 1067174 A * 1/1984

*Primary Examiner* — Robert Canfield
(74) *Attorney, Agent, or Firm* — Vera Chernobylsky

(57) ABSTRACT

The invention concerns the construction process and can be employed in the course of construction of buildings and structures of different purposes in order to reduce labor consumption during formation of floor slabs, and to facilitate integrity retention of a slab and hoisting equipment during the rotation operation.

The carcassing method assumes simultaneous construction of bearing solid-cast reinforced-concrete structural vertical elements and hinged to them vertically oriented reinforced-concrete pivot floor slabs. The construction process involves preliminary installation of separating elements between slabs and bearing structures as well as between adjacent slabs. After the concrete has developed its strength, the above slabs shall be flipped to the horizontal position and butt joints between slabs and bearing vertical elements as well as between adjacent floor slabs shall be grouted. The vertical elements and floor slabs are formed in layers, vertical partition elements represent sheet-type or film-type polymer materials, the pivot hinge of floor slabs represent an elongated element located in the middle portion of a floor slab and whose longitudinal axis coincides with the slab rotation axis.

(Continued)

Bearing elements shall be formed as columns.

Tubular round-in-section hinge elements of horizontally adjacent floor slabs shall be located at opposite sides of the longitudinal axis of a column.

Floor slabs shall be reinforced by a prestressed reinforcement cage made of a sheathed steel cable.

Tendons shall be installed inside of floor slabs after their formation. For this, the solidifying grout is fed into cavity of the slip formwork inside a slab, linear voids are formed by means of channel formers.

The longitudinal axis of a hinge runs through the mass center of a floor slab.

Slabs shall be flipped in the ascending and descending order.

Channel formers shall be shifted upon shifting the formwork or upon transition to the next layer.

Channel formers shall comprise the broach for installation of tendons in channels.

Channel formers are equipped with vibrators for compaction of the grout.

After rotation of slabs, the reinforcing cable shall be placed inside transverse channels and shall be tensioned.

10 Claims, 9 Drawing Sheets

(51) Int. Cl.

| | |
|---|---|
| ***E04B 1/16*** | (2006.01) |
| ***E04B 1/22*** | (2006.01) |
| ***E04C 5/10*** | (2006.01) |
| ***E04B 1/20*** | (2006.01) |
| ***E04G 11/22*** | (2006.01) |
| ***E04G 11/36*** | (2006.01) |

(52) U.S. Cl.
CPC ..... *E04C 5/10* (2013.01); *E04G 11/22* (2013.01); *E04G 11/36* (2013.01)

(56) References Cited

U.S. PATENT DOCUMENTS 3,921,362 A * 11/1975 Ortega ..... E04B 1/3538 52/745.14
2011/0302880 A1* 12/2011 DiPietro ..... E04C 5/165 52/834

* cited by examiner

METHOD FOR ERECTING FRAMEWORK OF STRUCTURES

The invention concerns the construction process and can be used during erection of buildings and structures of different purposes.

The construction industry knows a building erection method assuming the forward construction of bearing walls followed by the formation of floors in the vertical position to subsequently flip them to the horizontal design position by means of the hinge (SU, A, No. 1067174, 1984). The conventional solution assumes the use of a heavy jack frame and a hoisting units for rotation of floor slabs whose end portions shall be supported by vertical props and adjacent slabs shall be then interconnected whereas their interjoints shall be grouted.

The shortage of the conventional solution is the necessity to use resource-consuming equipments for erection of a structure, or rotation of floor slabs. Besides that, this operation of floor slab rotation to the horizontal position requires the use of reliable and powerful equipment enabling the smooth rotation of a slab.

The claimed invention somewhat resembles a ceiling method assuming simultaneous construction of reinforced-concrete bearing walls of buildings or structures and construction of floors. In the course of construction, significant amounts of the concrete mixture is fed into the space delineated with the slip formwork panels according to the conventional procedure what leads to formation of relatively thick layers. Floor slabs formed in the vertical position shall be connected with bearing walls by means of tendons acting as a hinge during rotation of slabs to the horizontal position by means of hoisting equipment (SU, A, No. 737600, 1980).

However, during rotation of a slab, tendons connecting it with a bearing wall undergoes bending and consequently loses it strength characteristics. Beside that, to flip a slab, it requires application of powerful hoisting equipment which, however, does not ensure elimination of the risk of exceeding the safe rotation speed what can cause damage to a supporting prop as well as the slab integrity violation or its end portion destruction.

The claimed method is aimed at reduction in labor consumption during formation of floor slabs, and facilitation of integrity retention of a slab and hoisting equipment during the rotation operation.

The above mentioned technical result can be achieved owing to the following: the carcassing method which includes simultaneous construction of bearing solid-cast reinforced-concrete structural vertical elements and hinged to them vertically oriented reinforced-concrete pivot floor slabs, for what the construction process involves preliminary installation of separating elements between slabs and bearing structures as well as between adjacent slabs, and the concrete strength development is followed by rotation of the above slabs to the horizontal position and by grouting butt joints between slabs and bearing vertical elements as well as between adjacent floor slabs, assumes that vertical elements and floor slabs are formed in layers, vertical partition elements represent sheet-type or film-type polymer materials, the pivot hinge of floor slabs represent an elongated element located in the middle portion of a floor slab and whose longitudinal axis coincides with the slab rotation axis.

Bearing elements shall be formed as columns.

Tubular hinge elements of horizontally adjacent floor slabs shall be located at opposite sides of the longitudinal axis of a column.

Floor slabs shall be reinforced by a prestressed reinforcement cage.

Tendons shall be installed inside of floor slabs after their formation. For this, the solidifying grout is fed into cavity of the slip formwork inside a slab, linear voids are formed by means of void formers.

The floor slabs shall be reinforced by the sheathed steel cable.

Hinges for floor slabs represent tubular element round in cross-section.

The longitudinal axis of a hinge runs through the mass center of a floor slab.

The horizontal partition element is made as modular.

Slabs shall be flipped in the ascending and descending order.

Channel formers shall be shifted upon shifting the formwork.

Channel formers shall be moved by means of the placer upon transition to the next layer.

Non-extractable channel formers shall be located in the grout.

Channel formers shall comprise the broach for installation of tendons in channels.

Channel formers are equipped with vibrators for compaction of the grout.

After rotation of slabs, the reinforcing cable shall be placed inside transverse channels and shall be tensioned.

The placer shall be equipped with a vibrator for compaction of the placed grout.

FIG. 1 contains the set for implementation of this method;

Figure 7:
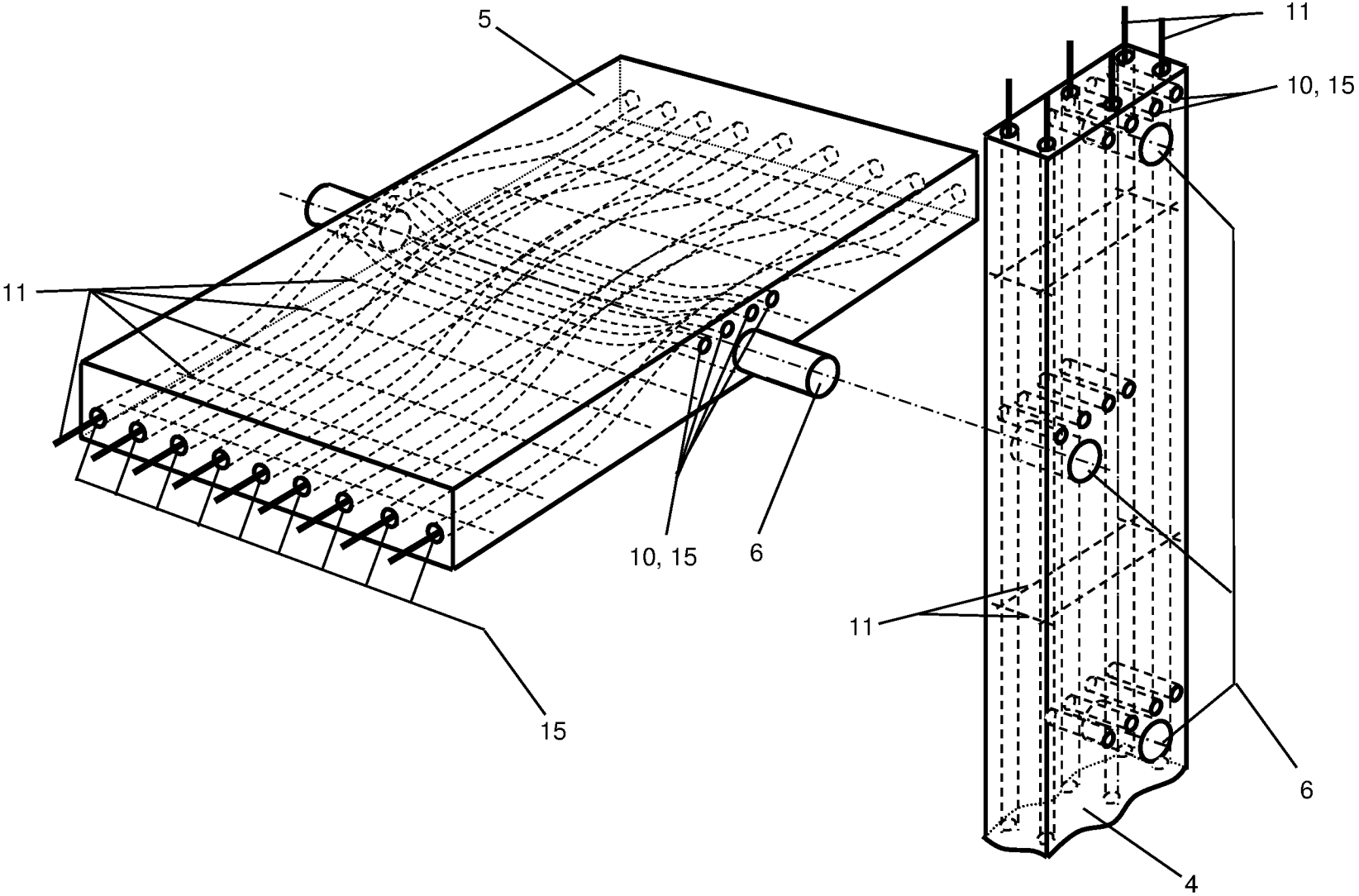

FIG. 7 contains the reinforcement layout of structural member.

Figure 8:
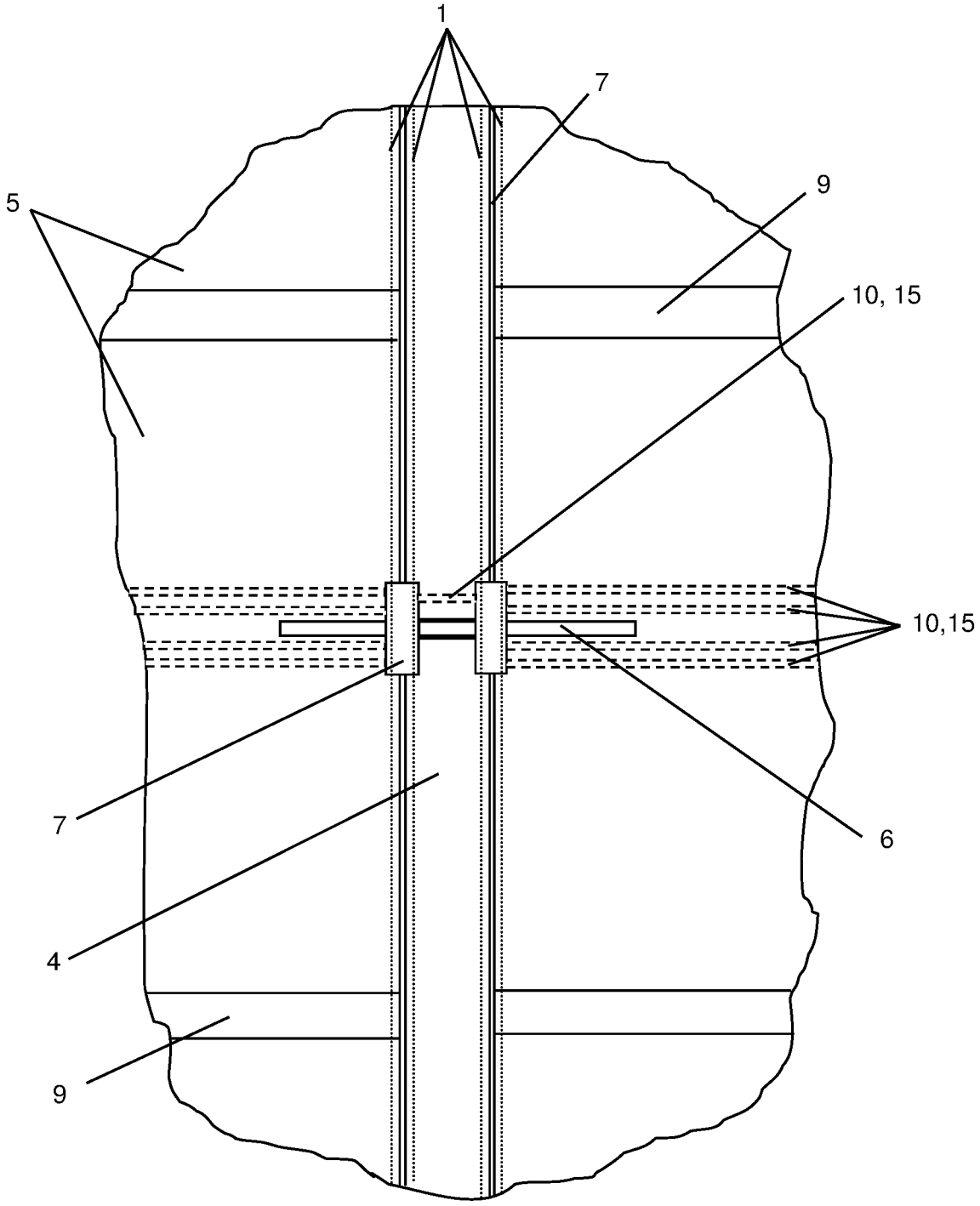

FIG. 8 shows fragmented front view of location of dividing elements in the wall being erected.

Figure 9:
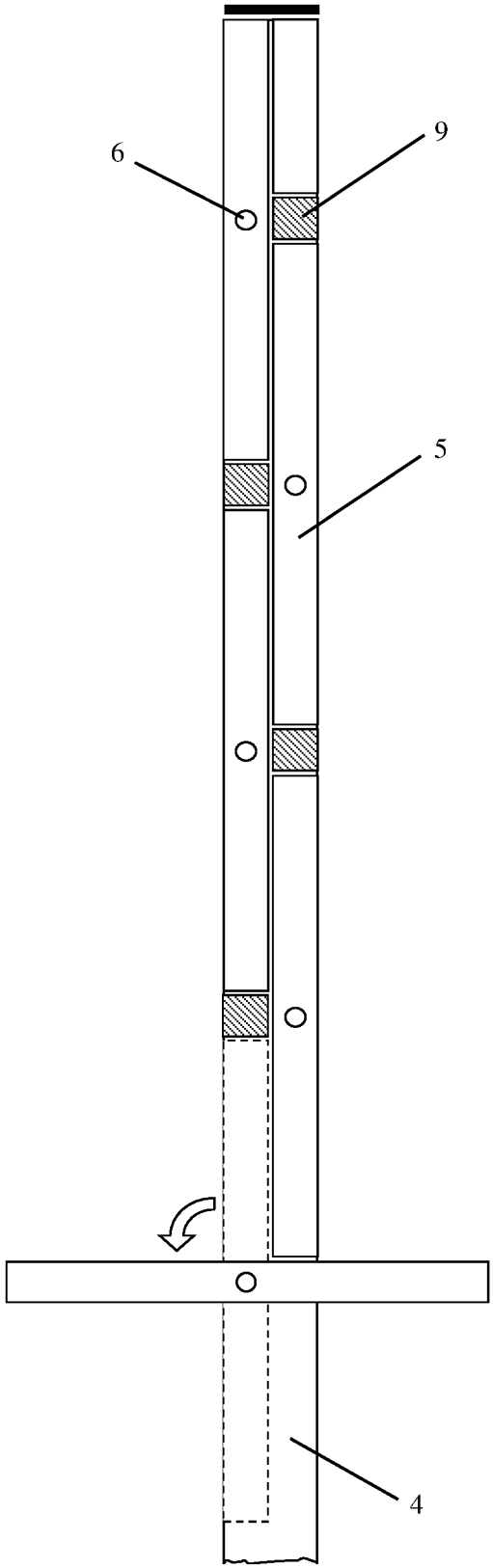

FIG. 9 shows side view of the location of the pivot hinges in the wall being erected, the rotation of the slabs in ascending order.

The method is implemented as follows.

According to the claimed method, the framework of a building or a structure may be set up by way of a formwork-less method assuming the layer-by-layer supply of the solidifying grout, given free side surfaces of a structure under construction, and subsequent elimination of hollows between adjacent layers, or with use of a more sophisticated sliding formwork.

During erection of structures with use of panels 1 of a sliding formwork whose hoisting jacks 2 are installed on bearing beams 3, or without any formwork at all, such a structure shall be cast in thin layers of a quick-hardening material.

This method assumes the layer-by-layer erection of bearing vertical reinforced-concrete elements (walls or columns) 4 concurrently with reinforced-concrete pivot floor slabs 5 vertically-oriented during erection and parallel to each other. The operation shall be carried-out by way of the layer-by-layer placement of the solidifying grout in the cavity of the slip formwork, provided that the thickness of formed layers shall not exceed 4-5 cm.

Bearing beams 3 shall be installed on both sides from vertical reinforced-concrete elements.

Pivot floor slabs 5 are connected with vertical bearing elements 4 my means of hinges 6 made in the form of elongated elements. Slabs 5 may be made as hollow-core elements.

The hinge represents 6 a tube grouted in the vertical bearing element 4, both ends of this tube are inserted into free ends of portions of a rod or a tube fixed inside the floor slab 5 and protruding over its opposite butts. The hinge 6 may be also made of a tube grouted into the floor slab 5 having a rod or a tube inserted therein and embedded in the vertical bearing element 4.

Reduction in friction in the hinge and facilitation of the slab rotation in the hinge may be achieved by application of rolling elements. The same result can be achieved by applying a slip coating or a lubricant on the hinge surface.

Longitudinal axis of the hinge 6 is oriented horizontally and coincides with the rotation axis of the floor slab 5 and passes through its center of mass.

If vertical bearing reinforced-concrete elements are cast in the form of columns 4, tubular hinge elements 6 of horizontally adjacent pivot floor slabs 5 shall be located on opposite sides from the longitudinal axis of the column 4.

There shall be a grout-insoluble polymer sheet-type and/or film-type separating material 7 installed between vertical elements of slabs 5 under formation and bearing elements including columns 4. This material shall also ensure a gap between the slab 5 and bearing elements 4 for enabling rotation of the slab 5 whereas between vertical walls of slabs 5 under formation, there shall be installed sheet-type or film-type interslab partition elements 8. Separating elements 7 and 8 shall be installed in cycles following up the layer-by-layer buildup of the slab 5.

Between heightwise-adjacent pivot slabs 5, there shall be installed separating elements 9 representing, for example, bars, rectangular tubes etc. and letting through any extractable void formers 10 and steel cables 11 whereas hampering any leaks of the solidifying grout. Openings (not shown) in separating elements 9 ensure the access to end portions of reinforcement elements 11 what enables their installation, tension, and fixation, for example: by anchors. The separating element 9 can be either integral throughout the length of the element (slab 5) or composite one.

Floor slabs 5 and vertical bearing elements are longitudinally reinforced with steel cables 11 unwound from a bank, such as the spool or reel 12 mounted on the frame (not shown) of the formwork, in the course of displacement of the latter. The placer 13 is also used for placing transverse reinforcing cables 11 at required levels, given that the steel cable 11 can be embedded at different depths inside the slab 5 and inside vertical elements 4, given that the placer 13 can adjust the position of the steel cable 11 inside slabs 5 and vertical elements 4 by shifting it to the design positions within the layers under formation. Steel cables 11 are encased in the external tubular grout-insoluble sheath (not shown) made of, for example, a polymer material and allowing the longitudinal travel of portions of the steel cable 11 inside the sheath after the solidifying material has developed its strength. At that, transversely-oriented channel formers 10 shall be embedded in the slab 5 and bearing element 4 within the area of location of the pivof hinge 6 (FIG. 7), for example: internal corrugated tubes with portions of the steel cable or wire, polymer thread etc. intended for being subsequently used as the broach 14 for placing steel cables 11 in channels 15 of pivot slabs 5 and vertical bearing reinforced-concrete elements (columns 4).

The slab 5 and longitudinal (vertical) bearing elements 4 may be alternatively reinforced with steel rods which then shall be installed in preliminarily formed linear voids (channels 15) inside these elements after formation of the slab 5. Steel rods may also be used for transverse (horizontal) reinforcement of the slab 5 and bearing reinforced-concrete elements 4. At that, a placer shall be used for placing rebars on a surface under formation.

Figure 4:
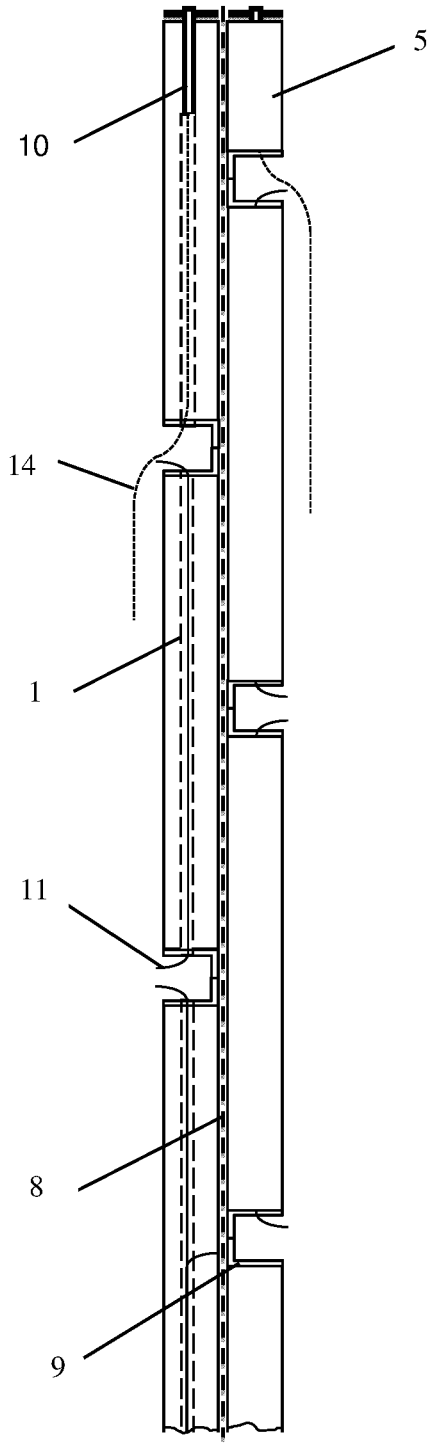
FIG. 4 shows the side view of the wall under construction with horizontal interslab partition elements.
Figure 5:
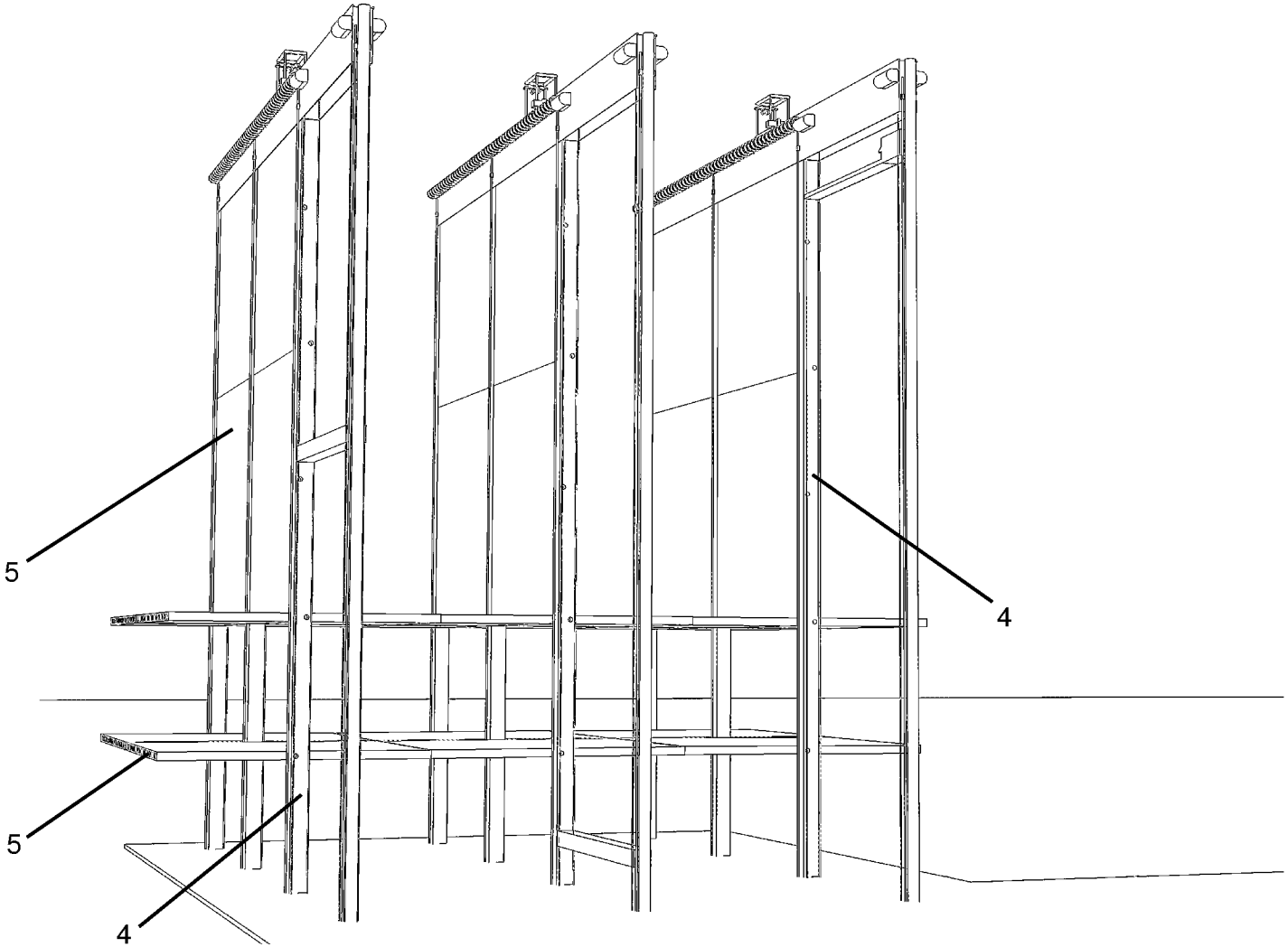
FIG. 5 shows the general view of the building framework under construction.
Figure 6:
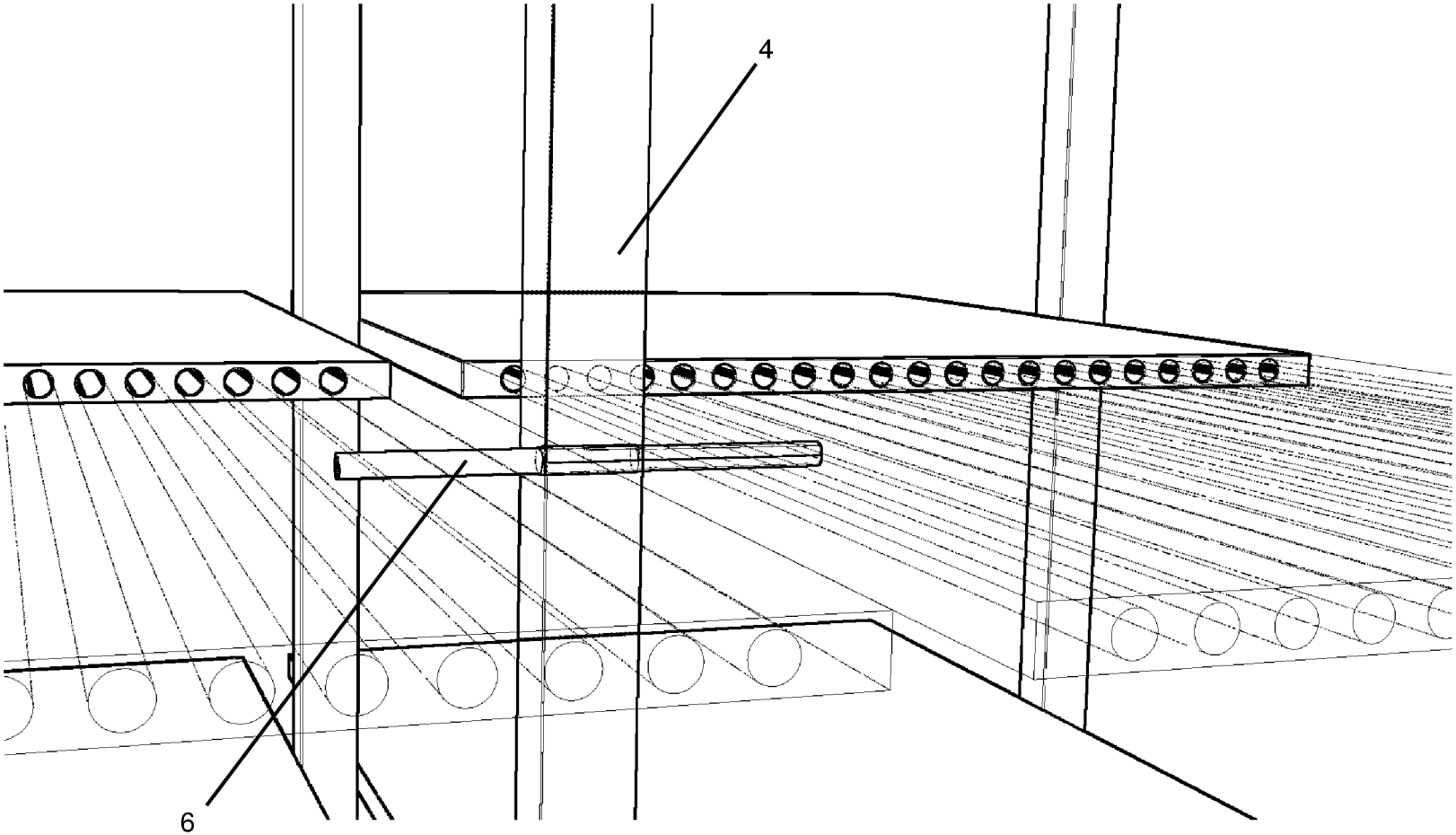
FIG. 6 shows the hinge inbuilt in the column.

The steel cable 11 may be laid in preliminarily formed channels 15 inside the slab 5 after their formation. For example, as it is shown in (FIG. 4), if there is the broach 14 fixed to the bottom part of the moving void former 10, and at the moment when the broach passes simultaneously through two (the upper one and the lower one) horizontal partition elements 9 of the same floor slab 5, the steel cable 11 shall be fixed to the bottom end of the broach 14 to be then dragged with the broach 14 through channel 15 and through the upper horizontal partition element 9.

After the solidifying grout has developed its strength, a stretching force shall be applied to the reinforcement in slabs 5 and bearing reinforced-concrete 4 in order to form a prestressed structure.

Transverse channels 15 in slabs 5 and bearing elements 4 shall be formed so that to be horizontally-oriented inside slabs 5 and bearing elements 4. After having been flipped to the design position, adjacent slabs 5 and vertical bearing elements 4 within a storey shall be interconnected by means of intrinsic reinforcement elements what is followed by application of a stretched force and subsequent fixation of the tendons.

Channels 15 can be formed both by extractable and non-extractable channel formers 10 made of the cardboard, polymer or other materials. Extractable channel formers 10 shall be shifted upon shifting the formwork Channels 15 can be formed with use of a bank (spool, reel 12) fixed to the formwork frame where the steel cable 11 is replaced with a corrugated tube having the broach 14 inside. This variant reduces weight loads on bearing beams 3 and the formfork frame (jack frame) etc. due to absence of the steel cable 11.

To form the channel 15 inside the slab 5 and bearing elements 4, any known method may be employed.

Reinforcement elements, hinges 6, separating elements 7, 8, 9, embedded parts, channel formers 10 etc. as well as the solidifying substance to be placed into the formwork cavity shall be delivered to the working height by means of the lift 16.

Figure 1:
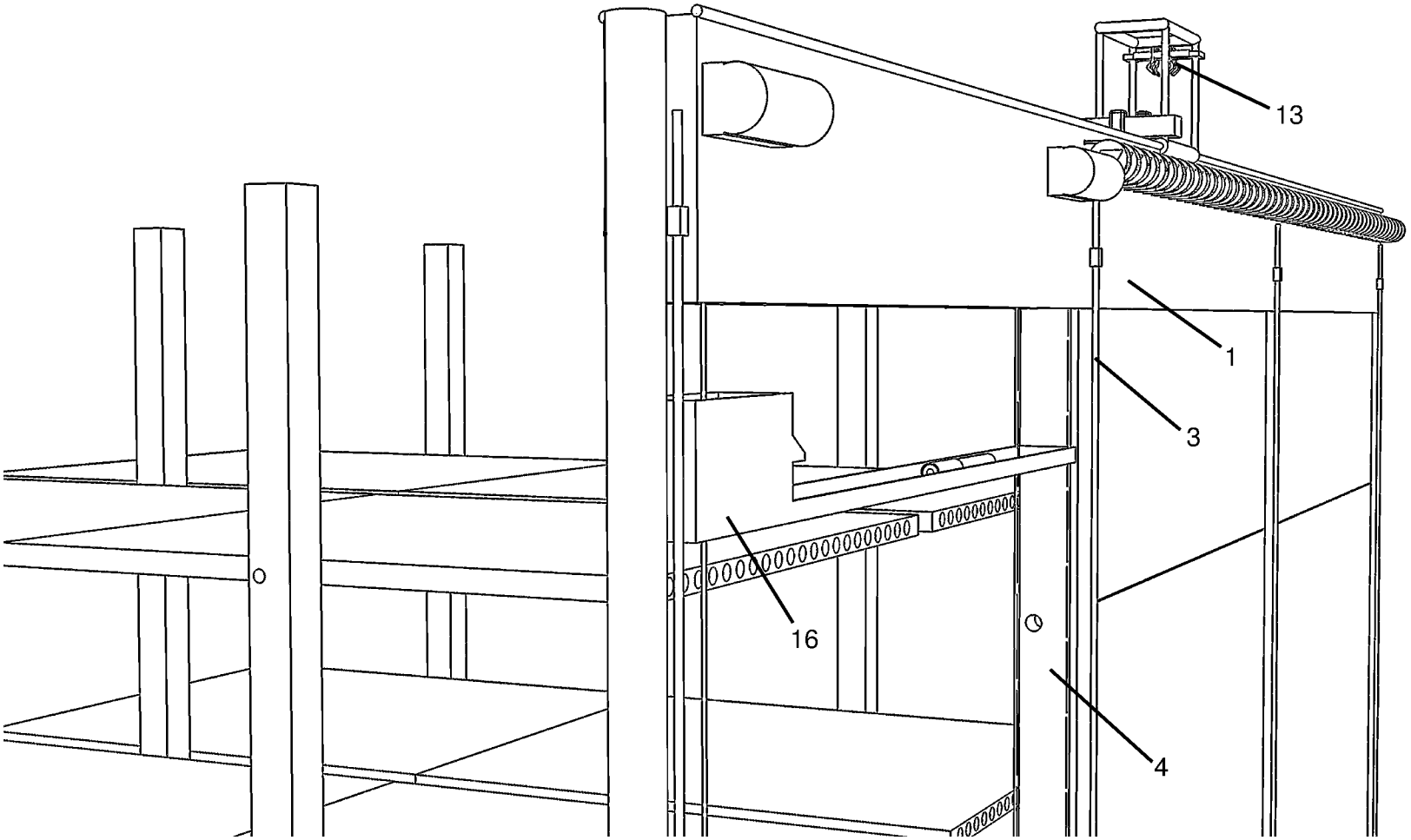
Figure 2:
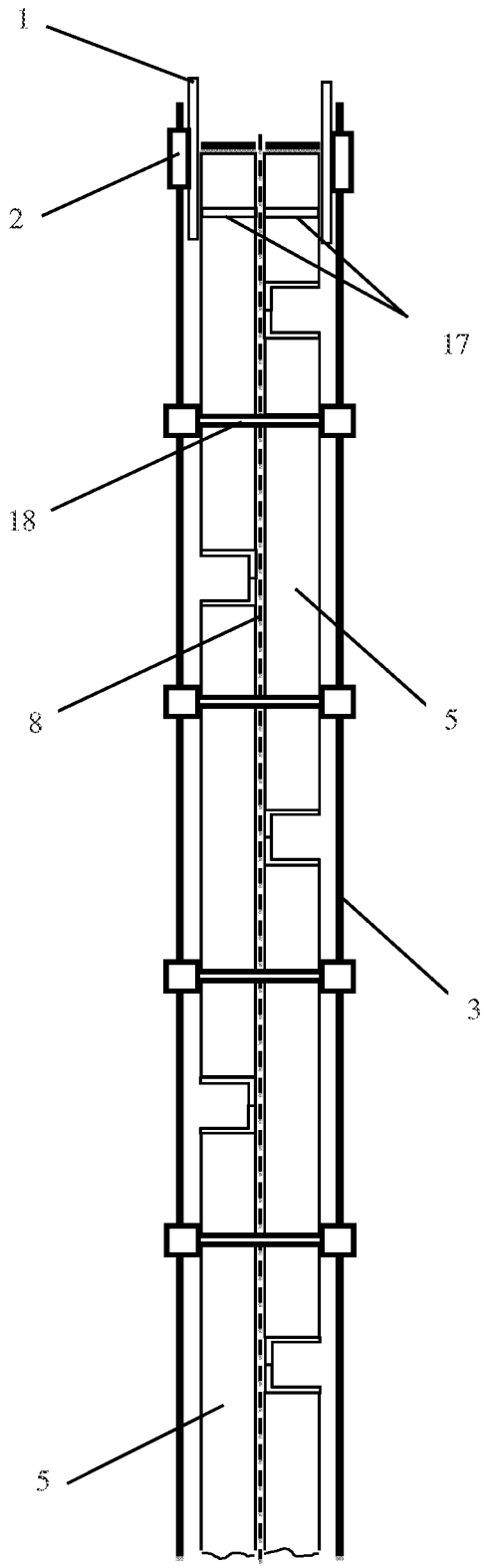
FIG. 2 shows the side view of the wall under construction.
Figure 3:
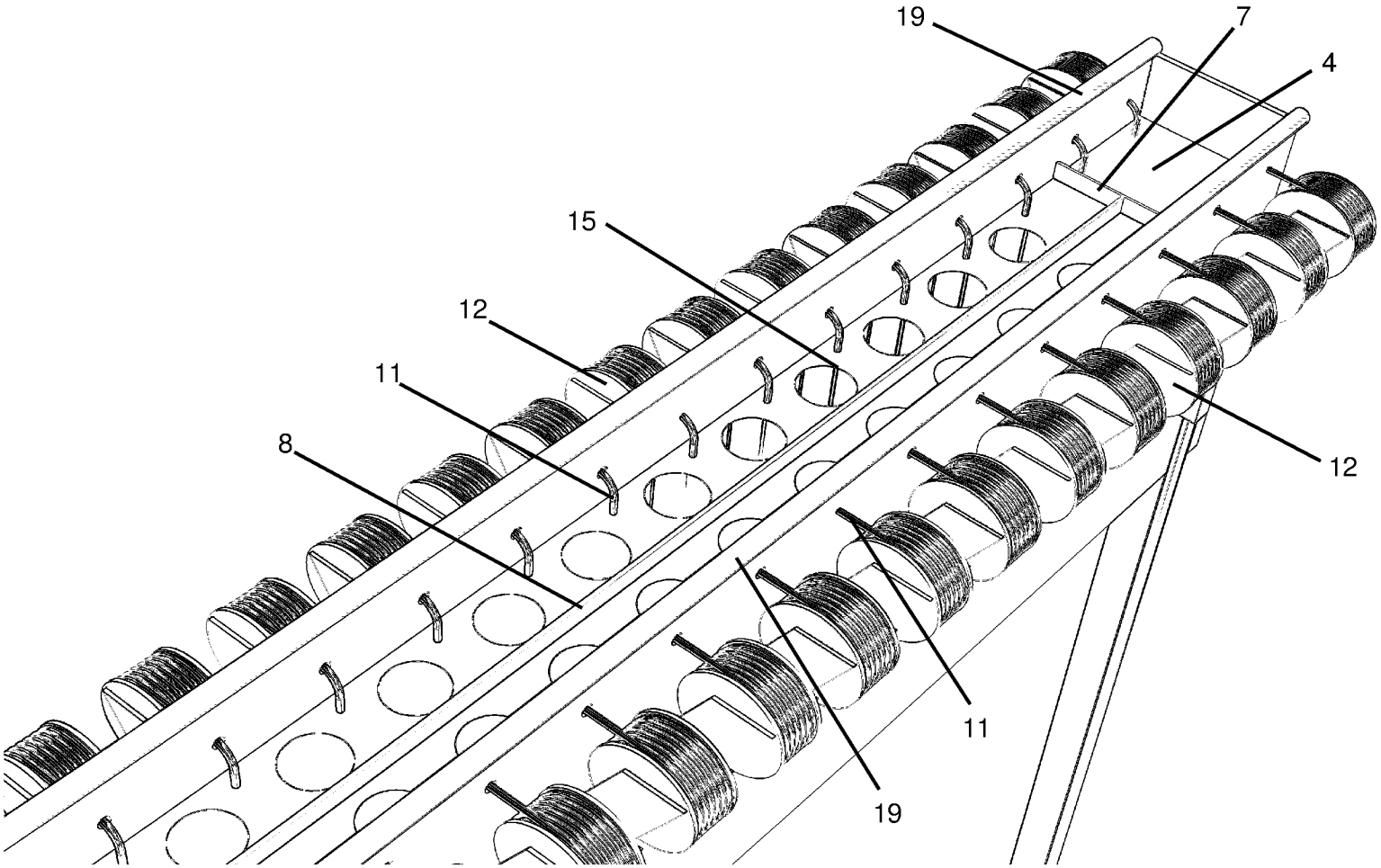
FIG. 3 shows the top view of the wall under construction.

In the course of formation of supporting framework structure by means of bearing elements 4 and adjacent slabs 5, the process of their construction includes embedding the channel formers 17 normal to surfaces of slabs 5 and columns 4, respectively. These channel formers are intended for letting through themselves any fastening jack beams 18 connecting the slabs 5 located on both sides of the vertical interslab partition element 8. Installation of fastening jack beams 18 ensures the rigid connection of bearing beams 3 with a structure under construction and interconnects bearing beams 3 (FIG. 2) what results in formation of the frame acting as a temporal external force belt while such a structure is being constructed and developing its strength until installation and tension of the reinforcement.

After having the construction materials hoisted, the placer 13 distributes them throughout a surface under formation.

The formwork panels 1 are interconnected by means of frames (not shown) and guiders 19 mounted on such frames and enabling displacement of the placer 13 along a layer under formation.

Placer 13 is intended for supplying a solidifying material to the surface of the previous layer into the cavity between panels of the formwork as well as for delivery of hinges 6 and reinforcing elements (steel rods and cables 11) to the place of their installation. Besides that, detachable equipment of the placer 13 enables displacement of void formers 10 within the body of pivot slabs 5 and vertical bearing 4 during their construction. The placer 13 can also adjust the position of the steel cable 11 inside the slab 5 by way of shifting it to the design position within a layer under formation. The placer 13 can be equipped with a vibrator for compaction of the solidifying material.

The rotation operation in respect of slabs 5 is preceded by tension of the reinforcement inside vertical bearing elements 4.

After the solidifying material of the floor slab 5 has developed its strength, the reinforcing cable 11 protruding over the longitudinal channel 15 beside one end of the slab shall be cut off provided that the free end has been preliminarily fixed by any of available methods, like the anchoring lock (not shown), and then the free end of the cable 11 shall be strained and fixed in order to create a prestressed structure of the slab 5 what is followed by setting the slab to the design position through its rotation about the longitudinal axis of the hinge 6 with subsequent extraction of separating elements 7, 8, and 9.

Slabs 5 of a building under construction shall be flipped either in the ascending or descending order. Depending on the adopted order of rotation of slabs 5 of a building, they shall be initially reinforced subject to the design disposition of tendons in the slab 5 after its flipping to the design position.

Rotation of the floor slabs 5 on a storey by any available method shall be followed by binding together either strained cables 11 by bundling their end portions protruding from adjacent slabs 5 or steel rods having been laid in longitudinal channels 15 after which transverse channels 15 within the area of pivot hinges 6 and vertical bearing elements 4 shall get cables 11 placed therein by means of broaches 14 in order to interconnect adjacent slabs 5 and vertical bearing elements 4 within the storey.

If necessary, butt joints of adjacent slabs 5 and vertical bearing elements 4 may be additionally strengthened by extra reinforcing elements. Tendons of vertical bearing elements 4 to be connected with tendons of channels 15.

The next stage includes the cementing (grouting) with binder mortars any interslab butt joints (slabs 5) as well as butt joints between slabs 5 and vertical bearing elements such as columns 4. After the grout in these butt joints has developed its strength, steel cables 11 having been laid in the above transverse channels 15 shall be strained in order to form a rigid structure prestressed in the horizontal plane within a storey of a building under construction.

In case of large spans and significant operational loads applied to a structure under construction, the concluding stage shall include the following operation: channels 15 and the free space between cable 11 and inner surface of the external tubular grout-insoluble sheath shall be filled with solidifying mortars ensuring their concurrent withstanding any external load.

The claimed method can be also employed for erection of bridge structures.

The invention claimed is:

1. A method for erecting a framework of a structure comprising:

simultaneously constructing vertical cast reinforced concrete bearing elements and vertical reinforced concrete floor slabs pivotally attached to the vertical cast reinforced concrete bearing elements;

pre-installing separation elements between:

(a) the floor slabs and the vertical cast reinforced concrete bearing elements; and (b) adjacent floor slabs;

rotating the floor slabs to a horizontal position after the concrete has developed strength;

grouting joints between:

(a) the floor slabs and the vertical cast reinforced concrete bearing elements; and (b) adjacent floor slabs;

wherein formation of vertical cast reinforced concrete bearing elements and vertical reinforced concrete floor slabs is carried out in layers;

wherein sheet-type or film-type polymer materials are used as vertical dividing elements;

wherein a linearly elongated element is used as a pivot hinge for each floor slab;

wherein the linearly elongated element is located in a middle portion of a respective floor slab; and wherein the longitudinal axis of the linearly elongated element coincides with the axis of rotation of the respective floor slab.

2. The method for erecting a framework of a structure according to claim 1, further characterized by that bearing elements are constructed in the form of columns.

3. The method for erecting a framework of a structure according to claim 2, wherein the pivot hinge of horizontally adjacent floor slabs are placed on opposite sides of the longitudinal axis of the vertical cast reinforced concrete bearing elements.

4. The method for erecting a framework of a structure according to claim 1, wherein floor slabs have a stressed reinforcement cage embedded therein.

5. The method for erecting a framework of a structure according to claim 4, wherein reinforcing elements are installed inside of floor slabs after floor slabs formation; wherein in the process of making floor slabs, linear cavities are formed by means of channel formers.

6. The method for erecting a framework of a structure according to claim 4, wherein floor slabs are reinforced by a sheathed steel cables.

7. The method for erecting a framework of a structure according to claim 1, wherein linearly elongated circular elements are formed as hollow round tubes used as floor slab hinges.

8. The method for erecting a framework of a structure according to claim 1, wherein the longitudinal axis of the pivot hinge runs through the respective floor slab center of mass.

9. The method for erecting a framework of a structure according to claim 1, wherein floor slabs are flipped in the ascending or descending order.

10. The method for erecting a framework of a structure according to claim 1, wherein after rotating floor slabs, reinforcing cable is placed in transverse channels and then strained.

* * * * *